United States Patent [19]

Hays

[11] 3,971,350

[45] July 27, 1976

[54] DISTRIBUTOR MEANS FOR HIGH SPEED ENGINES

[75] Inventor: Bill J. Hays, Midway City, Calif.

[73] Assignee: Bill J. Hays International Inc., Midway City, Calif.

[22] Filed: Feb. 11, 1974

[21] Appl. No.: 441,650

[52] U.S. Cl. ..... 123/117 R; 123/117 A; 123/146.5 A

[51] Int. Cl.[2] ..... F02P 5/04

[58] Field of Search ..... 123/149 R, 148 E, 146.5 A, 123/117 R; 324/167; 73/118; 33/180 AT

[56] References Cited

UNITED STATES PATENTS

| | | | |
|---|---|---|---|
| 2,263,859 | 11/1941 | Eldredge | 324/16 T |
| 2,712,814 | 7/1955 | Harr | 123/117 R |
| 2,792,439 | 5/1957 | Miller | 123/149 R |
| 3,203,412 | 8/1965 | Kuritza et al. | 123/148 E |
| 3,219,878 | 11/1965 | Konopa | 123/148 E |
| 3,559,629 | 2/1971 | Sauvignet | 123/148 E |
| 3,626,455 | 12/1971 | Toda et al. | 123/117 R |
| 3,767,902 | 10/1973 | Estes et al. | 324/16 T |
| 3,776,206 | 12/1973 | Hunt | 123/117 R |
| 3,783,314 | 1/1974 | Kostan | 123/148 E |
| 3,791,357 | 2/1974 | Cook | 123/117 R |
| 3,807,372 | 4/1974 | Garcea | 123/117 R |
| 3,817,234 | 8/1974 | Jirousek | 123/117 R |
| 3,857,086 | 12/1974 | Mooney et al. | 73/118 |
| 3,888,225 | 6/1975 | Boyer et al. | 123/148 E |

*Primary Examiner*—Charles J. Myhre
*Assistant Examiner*—Paul Devinsky
*Attorney, Agent, or Firm*—Fulwider, Patton, Rieber, Lee & Utecht

[57] ABSTRACT

There is disclosed an electrical pulse generator for generating a train of high voltage pulses for spark ignition of multi-chamber, internal combustion engines operated at high speeds. The pulse generator comprises rotatable means mounted on the output shaft of the engine, typically on the dampener of the engine with cooperative pulse generating means carried on the engine housing adjacent the output shaft and responsive to the rotation thereof to generate the train of voltage pulses. In its preferred embodiment the pulse generating means comprises a coil winding which is mounted on a bracket secured to the engine with magnetic field generating means, such as a permanent magnet, to establish a magnetic circuit through the interior of the coil and magnetic flux means carried by the rotatable means mounted on the output shaft of the engine to generate a timed change in the magnetic flux of the magnetic circuit, thereby generating a train of induced voltage pulses in the coil windings. Typically, the magnetic flux means can comprise a plurality of machine bolts which are threaded into tapped bores about the periphery of the torsional dampener which is mounted on the engine crankshaft. The invention also comprises the combination of the aforedescribed pulse generator with the more conventional pulse generator usually contained within a conventional distributor for generating and distributing a train of high voltage pulses in an internal combustion engine.

11 Claims, 3 Drawing Figures

DISTRIBUTOR MEANS FOR HIGH SPEED ENGINES

BACKGROUND OF THE INVENTION

1. Field of the Invention

This invention relates to spark ignition of internal combustion engines having multiple cylinders such as multi-cylinder, reciprocating piston engines and multi-chambered rotary engines.

2. Description of the Prior Art

Internal combustion engines of multiple combustion chambers most commonly employ a Kettering ignition system to generate a train of high voltage surges useful for spark ignition. This system utilizes an ignition coil having primary and secondary windings to generate a train of high voltage surges in the coil's secondary windings by the intermittent building and collapsing of the magnetic field generated by a low voltage, pulsed current flow through the primary windings of the coil. The train of high voltage pulses so generated is applied through a distributor means including a rotor and cooperative terminal posts to direct a high voltage pulse to the proper cylinder for ignition of the air-fuel mixture in the cylinder at a predetermined, timed angular relationship to the position of the piston in the cylinder in a reciprocating piston engine or the position of the rotor in the toroidal chamber of a rotary engine. Typically, with a reciprocating engine, the voltage pulse is applied at an angle from zero to about 45° before the piston reaches its top dead center position.

The train of voltage pulses of low voltage applied to the primary windings of the ignition coil is generally applied from the battery of the engine with breaker points which are actuated by a cam mounted on the distributor shaft to open and close the circuit at the preselected, proper times for building and collapsing the magnetic field in the ignition coil, thereby generating the train of high voltage pulses employed for ignition.

Optimum performance of an engine demands a variation in ignition timing which is responsive to either or both of engine speed or load. To this end, suitable spark advance means are provided whereby the ignition timing can be advanced in response to increasing speed or loading of the engine.

Commonly, the distributor and pulse generator contained within the distributor housing are driven by a mechanical linkage from the cam shaft of the engine. The cam shaft, in turn, is driven by mechanical gearing or chain linkage from the crankshaft of the engine. At high engine speeds, such as commonly encountered in racing engines, e.g., greater than about 5,000 revolutions per minute, the aforedescribed mechanical linkages between the pulse generator and the output shaft or crankshaft of the engine can cause a considerable error in the ignition timing, i.e., the timed angular relationship between such shaft and the pulses of the train of voltage pulses. This error is caused by an unavoidable lash in the mechanical gearing or chain linkage and/or the torsional strain on the cam shaft. This causes a loss in the amount of preset advance in the train of ignition voltage pulses, thereby resulting in a loss of power developed by the engine.

A great variety of ignition systems have been proposed to improve the basic Kettering system of spark ignition. Most of these systems, however, have employed pulse generating means which include a rotatable member that is driven through a complex mechanical linkage from the crankshaft and which thereby suffers the aforedescribed disadvantageous loss of power at high engine speeds. It is, therefore, an object of this invention to provide a voltage pulse generator which includes rotatable means mounted directly on the output shaft of the engine at a precise angular orientation thereto.

It is desirable in racers to have means whereby the ignition timing can be varied by the driver. In particular, it is desirable that provision be made for the variation in the amount of advance in the ignition timing cycle so that the engine can be readily started and operated throughout the range of engine speeds encountered in racing. It is also desirable that means is provided to vary the degree of advance of the ignition timing cycle in response to engine temperatures to avoid overheating the engine which can occur when operating an engine at maximum spark advance over prolonged periods of time, such as encountered in long distance races.

SUMMARY OF THE INVENTION

The invention comprises a pulse generator which includes a rotatable member that is mounted on the output shaft, typically the crankshaft of the engine. In its preferred embodiment, the invention comprises a plurality of elements of a metal of high magnetic permeability that are secured at predetermined angular positions onto the torsional dampener of a conventional, multi-cylinder, reciprocating piston engine. The pulse generator also includes voltage pulse generating means which comprises a coil winding with a magnetic field generating means such as a permanent magnet, to establish a magnetic circuit through the interior of the coil windings. This voltage pulse generating means is positioned on the engine adjacent the torsional dampener so that the rotation of the dampener, with its associated elements of a metal of high magnetic permeability, induces a train of voltage pulses in the coil windings which is in synchronism with the crankshaft of the engine. The train of voltage pulses so generated in the coil windings is then amplified with suitable amplification means and applied to the primary windings of a conventional ignition coil whereby a train of high voltage surges is generated in the coil secondary windings and applied, through the conventional distributor rotor and terminal posts to the spark ignition means of the proper engine cylinder in a predetermined, timed relationship to the rotation of the crankshaft. This voltage pulse generator avoids all of the complex mechanical linkages between the engine crankshaft and distributor shaft, thereby avoiding the inherent loss in spark advance encountered by torsional strain on the engine cam shaft and lash in the mechanical gearing or chain linkages of the distributor shaft drive system.

In its most preferred embodiment, the invention comprises the aforedescribed pulse generator in combination with another pulse generator such as that commonly contained within the distributor housing of a spark ignition engine. Switch means are provided whereby the operator of the engine can select between the two pulse generators and thereby have the capability of manually adjusting the ignition timing by switching between trains of voltage pulses having predetermined and distinctly different angular relationships to the output shaft of the engine.

The aforedescribed improvements have numerous advantages, particularly when applied to high speed engines such as employed on racing cars. The conventional distributor contains a distributor shaft which is driven through a gear linkage by the cam shaft of the engine that, in turn, is driven by timing gears or a timing chain from the crankshaft or output shaft of the engine. There is an unavoidable lash in mechanical or chain gearing which induces an appreciable error in the ignition timing, particularly when the engine is operated at high speeds, e.g., above about 5,000 revolutions per minute. Additionally, the loading on the cam shaft causes a considerable torsional strain of the shaft which also results in a significant change in the ignition timing. As a result, precise timing and control of the ignition cycle of the engine is not possible and the engine fails to develop its maximum horsepower. Such difficulties are obviated by this invention which utilizes a pulse generator which is operative to produce a precisely timed train of voltage pulses having a fixed angular relationship to the output shaft. When the aforedescribed pulse generator is combined with the conventional distributor pulse generator, which has the conventional spark advance means responsive to load and/or engine speed, the operator is provided with the capability of electing between a plurality of trains of voltage pulses having varied angular relationships to the output shaft for optimum performance and operation of the engine.

BRIEF DESCRIPTION OF THE DRAWINGS

The invention is illustrated by the drawings of which.

DESCRIPTION OF THE PREFERRED EMBODIMENTS

Figure 1:
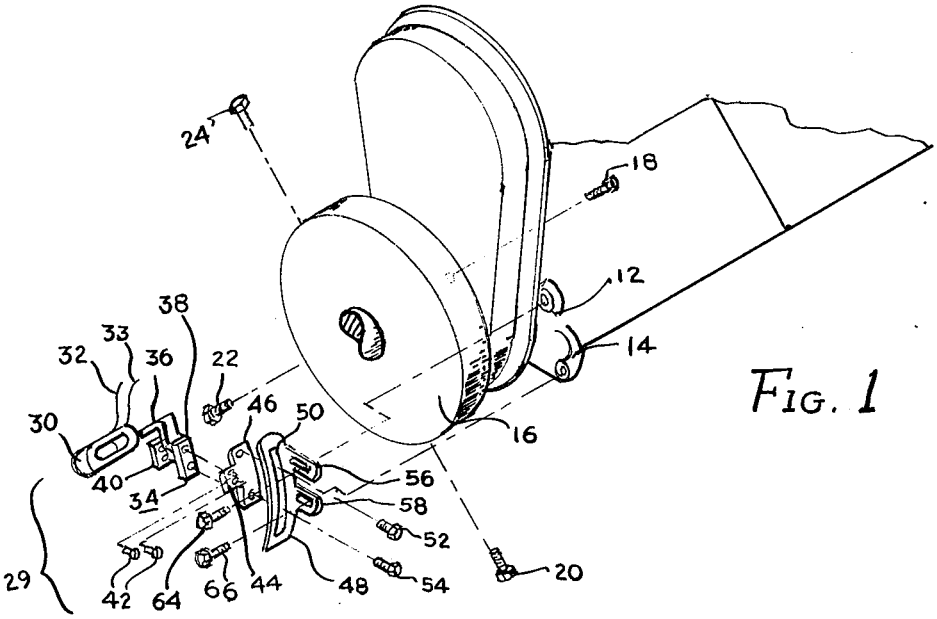
FIG. 1 illustrates the pulse generator of the invention for an eight cylinder internal combustion engine.

Referring now to FIG. 1, a portion 10 of an engine block of a typical V-eight, reciprocating piston engine is illustrated that has suitable means such as bosses 12 and 14 in the proximity of torsional dampener 16 having threaded bores located therein. The torsional dampener 16 is, of course, fixedly mounted on the output or crankshaft 26 of the engine. The pulse generator of the invention includes a rotatable member that is mounted on the crankshaft and, to this end, torsional dampener 16 can be adapted for use as the rotatable element. The torsional dampener 16 can be bored and tapped with a plurality of bores to receive elements of a metal of high magnetic permeability, such as conventional steel machine bolts 18, 20, 22 and 24, which are mounted at 90° increments (for an eight-cylinder engine) about the torsional dampener and which are thereby placed at predetermined and fixed angular relationships to the crankshaft 26 of the engine. Preferably, the elements are mounted on the dampener at an optimum advance for the ignition timing cycle to be utilized in the engine. Typically, in an eight-cylinder, reciprocating piston engine the magnitude of this advance can be from 35° to about 45°, preferably from about 38° to about 42°.

The pulse generating means 29 includes a coil 30 having windings connected to electrical leads 32 and 33. The coil is carried by pole piece 34 which is generally L-shaped with a base leg 36 that is radially oriented toward crankshaft 26. The remaining leg 39 of this bracket carries magnetic field generating means such as permanent magnet 40 and threaded bores for receiving machine screws 42. The latter extend through bores in a projecting tab 44 of second bracket means 46 that is fixedly carried in a sliding manner on main bracket 48. Main bracket 48 has a longitudinal groove 50 through which machine screws 52 and 54 are extended into threaded engagement with tapped bores in the second bracket means 46. The main bracket 48 bears two projecting tabs 56 and 58 which have elongated grooves for receiving machine bolts 64 and 66 which extend into the tapped bores in bosses 12 and 24, respectively.

The pulse generating means thus described is installed on the internal combustion engine and the position of main bracket 48 is adjusted thereon to provide a suitable air gap between the head surfaces of machine bolts 18–24 and the opposed, inwardly facing lower edge of leg 36, e.g., a spacing of from 0.001 to about 0.01 inch. The second bracket 46 is adjusted in its position along groove 50 of main bracket 48 so as to experience the passage of an element 18–24 beneath its inward face at a predetermined angular relationship to the crankshaft and, hence, the pistons of the engine. Preferably the pulse generating means of this invention is set for a predetermined optimum, high-gear, advance in the ignition timing cycle and can be from 35° to 45°, preferably from 38° to 42°, before the piston in the ignited cylinder reaches top dead center with most internal combustion eight-cylinder engines.

As thus described, the invention comprises a pulse generator having a predetermined and fixed angular advance of the ignition cycle that, preferably, is set at an optimum advance for high speed operation of the engine in the high gear or upper gears of the transmission. Engines having such advances are difficult to start, and, accordingly, it is preferred to combine the aforedescribed pulse generating means with a more conventional pulse generating means having a distinctly different, e.g., lesser, angle of advance of the ignition timing cycle. Such a system also provides a substantial flexibility in the ignition timing of an engine, particularly if one or both of these pulse generating means has adjustable advance means whereby the advance of its ignition timing is variably adjustable in response to engine load or vacuum or both and if switch means is provided which is operable by the driver of a vehicle powered by the engine so that the ignition timing circuit can be operated at its maximum angle of advance during acceleration through the lower gear ratios and high engine speeds and the engine can be switched to an ignition cycle with a lesser angular advance in the high gears or when excessively high engine temperatures result from prolonged operation at maximum advance of the ignition timing cycle.

The metals of high magnetic permeability referred to herein are ferrous metal, including iron and carbon and stainless steels. Preferably, the so-called "soft" magnetic metals are used. Examples of these are iron and alloys thereof with major amounts of nickel and, optionally, lesser amounts of molybdenum, silicon, chromium, aluminum, e.g., Permalloy, MoPermalloy, Supermalloy, Monimax, Sinimax, Numetal, Deltamax, Isoperm, Conpernik, Perminvai, etc.

Figure 2:
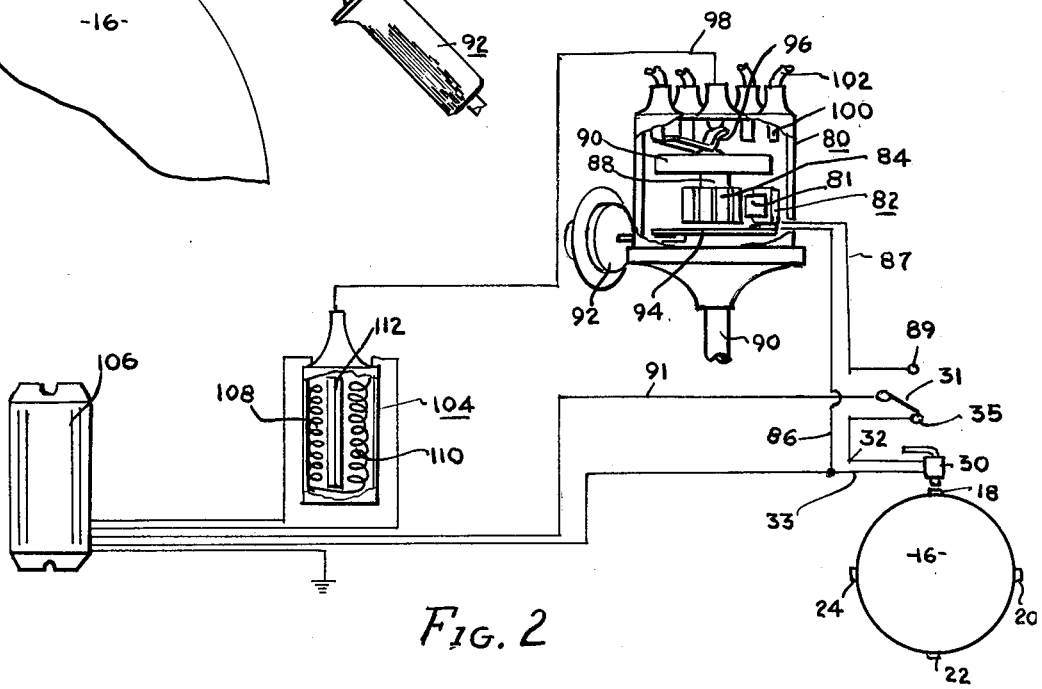
FIG. 2 illustrates the combination of two pulse generators with switch means for use by the operator of the engine.

FIG. 2 illustrates an embodiment of the invention which utilizes the conventional pulse generator of an internal combustion engine and the pulse generator of this invention. In this embodiment, a conventional distributor 80 is shown in combination with the pulse generator 82 of the invention. The latter is shown as torsional dampener 16 containing peripherally mounted elements 18–24 which are formed of a metal of high magnetic permeability, and pickup coil 30 with conducting leads 32 and 33 extending therefrom.

Distributor 80 is fairly conventional in construction and can comprise a pointless-type pulse generator such as that formed by a coil winding 81 carried on an upstanding bracket bearing a permanent magnet carried by pole piece 83 and a magnetic flux wheel 84 having a plurality of upstanding radial projections or ribs mounted on sleeve 88 which extends upwardly to the conventional centrifugal advance mechanism 90. Sleeve 88 is carried on distributor shaft 90 and is rotatably driven thereby.

The distributor also includes conventional vacuum advance means 92 which is mechanically connected to breaker plate 94 on which is mounted the pickup coil assembly of elements 82 and 83. The vacuum advance mechanism 92 is connected to the manifold vacuum and is operative to advance the ignition timing cycle in response to increasing load on the engine. Typically, the vacuum advance unit is operative to advance the ignition timing approximately 10° to 20° and the centrifugal advance mechanism 90 is operative to advance the timing of the ignition cycle from 25° to about 35°.

The distributor also contains a rotor 96 which is contacted by the center, high tension lead 98 from the secondary windings of the ignition coil. Spaced about the periphery of the undersurface of the distributor cap are a plurality of terminal posts 100 corresponding to each of the cylinders of the engine so that rotation of the rotor in a timed manner will direct the high voltage surge in lead 98 to one of the plurality of ignition leads 102 in the conventional synchronized manner with the crankshaft of the engine.

The remaining elements of the combined ignition system comprise coil 104 and a suitable pulse amplifier means 106. The coil 104 is conventional in construction and includes primary windings 108 and secondary windings 110 which are disposed about a magnetic core 112. These elements are illustrated diagrammatically, not structurally, in FIG. 2. Lead 33 from coil 30 of the pulse generator of this invention extends to pulse amplifier 106 and is joined by a similar lead 86 of the same polarity which extends from pickup coil winding 81 of the pulse generator within distributor 90. Lead 32 from the coil 30 extends to switch contact 35 and similar lead 87 from pickup coil winding 81 extends to switch contact 89. The lever contact of this switch means is attached to lead 91 that extends to pulse amplifier 106 as an input lead thereto.

The pulse amplifier means can be any suitable means for the amplification of a direct-current voltage pulse. Preferably, such amplification means is one of those that are commercially available from Hays Enterprises, Midway City, California, under the trademarks Magna Pulse or Stinger. The amplified voltage output from pulse amplifier 106 is applied to the primary terminals 111 and 113 of the ignition coil.

The operation of an engine equipped with the ignition circuit described and illustrated in FIG. 2 is fairly apparent from the preceding description. The operator can select the pulse generating system of his choice to provide a pre-selected degree of advance in the ignition timing cycle of the engine. The engine would, preferably, be started with the switch lever 31 in contact with the switch pole 89 so that the pulse generator of the conventional distributor is utilized for starting the engine. Typically, such a pulse generator would have from 10° to about 20° of advance in the ignition cycle at starting engine speeds.

After the engine has started, the advance mechanisms of the pulse generator within distributor 90 are operative to provide the optimum degree of advance for acceleration of the vehicle. Preferably, the centrifugal advance mechanism is set to provide a maximum degree of advance in the ignition cycle, e.g., from 40° to about 50°. The engine can be operated at this maximum advance through the acceleration of the vehicle to obtain maximum power output from the engine. Generally, when the vehicle is shifted into top gear, the operator would wish to switch to the pulse generator of this invention which can have a lesser angle of advance, e.g., from 30° to about 45°, preferably from 35° to about 42°, and which would therefore be more suitable for operation at the lower engine speeds encountered in the top gear of the vehicle. The operator could also switch to the pulse generator of the invention and its associated lesser amount of advance in the ignition cycle in the event that overheating of the engine is experienced when operating for prolonged times with a pulse generator having a greater degree of advance of the ignition timing cycle associated therewith.

Figure 3:
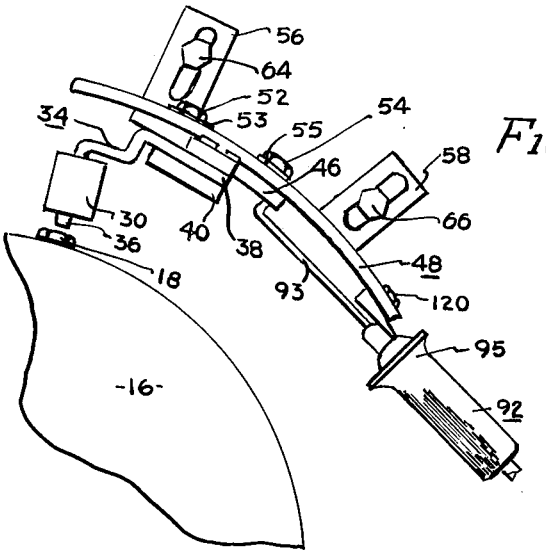
FIG. 3 illustrates the utilization of vacuum advance means with the distributor means of the invention.

While the pulse generator of the invention has been described with regard to means having a predetermined and fixed advance in the ignition timing cycle, it is apparent that means to vary this degree of advance in response to engine speed and/or loading can be readily provided. Such means could be in the form illustrated in FIG. 3. This figure illustrates a view of the pulse generator of the invention which includes a vacuum advance means 92 that can be secured to the undersurface of main bracket 48 by suitable means such as bolt means 120. This vacuum advance means includes a rod 93 which projects from the vacuum canister 95 and has a finger 97 which can be placed into a mating aperture drilled into second bracket means 46. In this embodiment, machine bolts 52 and 54 are provided with washer means 53 and 55 to provide a sliding support bracket means 46 and main bracket 48 whereby the movement of rod 93 of vacuum unit 92 can effect the reciprocation of bracket means 46 along groove 50 in bracket 48, thereby changing the angular orientation of coil 34 about the crankshaft 26 of the engine.

Although not illustrated in the figures, the torsional dampener 16 could be secured on crankshaft 26 of the engine with suitable mechanical advance means such as a centifugal weight similar to the type used in a conventional distributor but sized appropriately for effecting relative movement of torsional dampener 16. Such a variation of the invention would provide both mechanical advance which is responsive to the engine speed, as well as the vacuum advance which is responsive to the loading of the engine with the pulse generating means of the invention.

A 1974 Hornet X model was provided with the pulse generator of the invention in the manner illustrated in FIG. 1. The car had a V-eight engine of 360 cubic inches. The best time established by this car using a distributor housed ignition pulse generator for a quarter-mile track was 9.30 seconds. After installation of the pulse generator of the invention, the car turned the quarter-mile race in 9.16 seconds at a top speed of 147 miles per hour. The necessary increase in horsepower for this performance calculated to 30 horsepower, which was achieved entirely by switching to the pulse generator of this invention.

The invention has been described with regard to the presently preferred and illustrated embodiment. It is not intended that this description of the invention be unduly limiting thereof. Instead, it is intended that the invention be defined by the means, and their obvious equivalents, set forth in the following claims.

I claim:

1. In an internal combustion engine having a crankshaft and a plurality of combustion chambers receiving an air-fuel mixture for combustion therein in a timed angular relationship to the rotation of said crankshaft and a high voltage pulse generating means including coil means with primary and secondary windings for generation of a train of high voltage pulses, a distributor having a distributor shaft rotatably mounted in a distributor housing and mechanically connected in a driven relationship to said output shaft, rotor means carried on said distributor shaft, conductor means extending from the secondary windings of said coil to said rotor and from terminal posts circumferentially disposed about said rotor to direct said train of high voltage pulses to spark means in each of said chambers in said timed relationship, a first voltage pulse generator mounted within said distributor housing and responsive to the rotation of said distributor shaft to generate a first train of voltage pulses in synchronism with the rotational speed of said distributor shaft, spark advance means on said distributor whereby the angular relationship between said first voltage pulse generator and said output shaft is variably adjustable from a minimum to maximum advance in response to varying conditions of one or both of engine speed and/or load to provide a first ignition timing, the improvement which comprises:

a second voltage pulse generator including rotatable means fixedly carried on said crankshaft and cooperative pulse generating means fixedly mounted on said engine to generate a second train of voltage pulses in synchronism with the rotation of said crankshaft and at a predetermined and fixed angular relationship thereto to provide an ignition timing retarded from the maximum advance of said first ignition timing;

first conductor means to apply said first train of voltage pulses to the primary windings of said coil;

second conductor means to apply said second train of voltage pulses to the primary windings of said coil; and switch means in said first and second conductor means whereby either said first or second train of voltage pulses can be applied to the primary windings of said coil.

2. The improvement of claim 1 wherein said second voltage pulse generator comprises:

a coil winding;

bracket means to secure said coil winding to said engine in proximity to said crankshaft;

magnetic field generating means including a magnet and a pole piece of metal of high magnetic permeability extending through said coil winding to establish a magnetic circuit through the interior of said coil winding; and a plurality of elements of a metal of high magnetic permeability carried at equally spaced angular increments about the periphery of said rotatable means whereby to generate a train of induced voltage pulses in said coil winding in synchronism with rotation of said crankshaft and at a precise angular orientation thereto.

3. The improvement of claim 2 including amplification means and third conductor means to apply said train of induced voltage pulses thereto.

4. The improvement of claim 3 wherein said first voltage pulse generator comprises:

a second coil winding;

second magnetic field generating means including a second magnet and a second pole piece extending through said second coil winding to establish a second magnetic circuit through the interior of said second coil winding;

second bracket means to support said second coil windings within said distributor housing in proximity to said distributor shaft;

second rotatable means, said means carried on said distributor shaft for generating changes in magnetic flux in said second magnetic circuit whereby to generate a second train of induced voltage pulses in said second coil winding in synchronism with rotation of said distributor shaft; and fourth conductor means to apply said second train of induced voltages to said amplification means.

5. The improvement of claim 1 wherein said engine is a reciprocating piston engine.

6. The improvement of claim 1 wherein said rotatable means comprises the torsional dampener carried on the crankshaft of said engine and bearing a plurality of elements of a metal of high magnetic permeability at equally spaced angular increments about the periphery of said dampener.

7. The improvement of claim 6 wherein said pulse generating means includes a coil winding, a magnet and a pole piece of a metal having a high magnetic permeability extending through said coil winding to establish a magnetic circuit through the interior of said coil winding and bracket means to support said coil winding, magnet and pole piece from the forward end of said engine block with said pole piece directed towards the periphery of said dampener.

8. The improvement of claim 7 wherein said bracket means bears adjustment means whereby the air gap between said elements and pole piece can be fixedly adjusted.

9. The improvement of claim 7 wherein said bracket means bears adjustment means whereby the angular orientation of said pole piece to said shaft can be varied.

10. The improvement of claim 7 wherein said metallic elements are steel machine screws threadably engaged in said bores.

11. The improvement of claim 1 including vacuum advance means carried by said bracket means and operative to advance the ignition timing of said engine in response to intake manifold pressure of said engine.

* * * * *